United States Patent [19]

Pettipas et al.

[11] Patent Number: 4,531,744

[45] Date of Patent: Jul. 30, 1985

[54] OPEN HOUSE - GAME

[76] Inventors: John A. Pettipas; Albert G. Pettipas, both of 1211 Cole Harbour Rd., Cole Harbour, Nova Scotia, Canada, B2V 1M9

[21] Appl. No.: 581,619

[22] Filed: Feb. 21, 1984

[51] Int. Cl.[3] ..... A63F 3/00

[52] U.S. Cl. ..... 273/275

[58] Field of Search ..... 273/267, 275, 271

[56] References Cited

U.S. PATENT DOCUMENTS

| | | | |
|---|---|---|---|
| 1,564,746 | 12/1925 | Barnard | 273/271 |
| 2,806,702 | 9/1957 | Baker | 273/275 |
| 3,111,320 | 11/1963 | Acosta | 273/271 |
| 3,512,779 | 5/1970 | McGauhey | 273/275 |
| 3,948,524 | 4/1976 | Ladd | 273/267 X |

*Primary Examiner*—Harland S. Skogquist
*Attorney, Agent, or Firm*—Ralph J. Broderick

[57] ABSTRACT

This invention is a novel and intriguing game, which may be played by from two to eight players. The game consists of a distinctive gameboard, having disposed thereon 25 contiguously connected squares, color-coded, 8 preferably pink, 8 preferably green and 9 preferably yellow, each square bearing playing indicia thereon; 27 stylized cards called "Open House Cards", numbered from 1 to 25 and two cards marked "Wild Cards"; three decks, or 156, conventional playing cards are also used in the game and 75 color-coded markers, 25 preferably red, 25 preferably blue and 25 preferably white are provided, to mark the capture of the squares during the game. The game is played according to specific rules of play, which form an integral part of the invention. The objective of the game is to capture and place a marker on a number of the contiguously connected squares, arranged on the gameboard, either across or, from top to bottom, or from side to side, of the gameboard and the squares are so arranged on the gameboard, that it is necessary to capture at least one yellow color-coded square, in order to make a contiguously connected line of captured squares across or from top to bottom, or from side to side of the gameboard. The player, or the first team of players, to accomplish this objective is the winner of the game. Provided no player, or no team of players, achieves this goal, the player, or team of players, capturing 13 squares first, wins the game.

3 Claims, 3 Drawing Figures

OPEN HOUSE - GAME

This is an invention relating to a novel and ingenious combination of apparatus and original rules of play which are combined to constitute an intriguing and amusing game, which may be played by from two to eight players and which provides entertainment, suspence and challenge to the players thereof.

The original features of the game and the embodiments thereof will appear from the description of the gameboard; the novel original cards; the three decks of conventional playing cards; the markers and the rules of play, hereinafter set out and illustrated by the drawings depicting the combined apparatus and rules, by which the game is played.

In the drawings in which the same numbers are used to illustrate the same parts:

FIG. 1 is a plan view of the gameboard, illustrating the disposition of the 25 numbered squares thereon and the playing indicia printed on each square thereof and illustrating the sections on the gameboard reserved for the stylized Open House Cards; the three decks of conventional playing cards used in the game and the conventional playing cards which are discarded in the course of play. The 25 squares on the gameboard are color-coded in three colors, as hereinafter set out.

Figure 1:
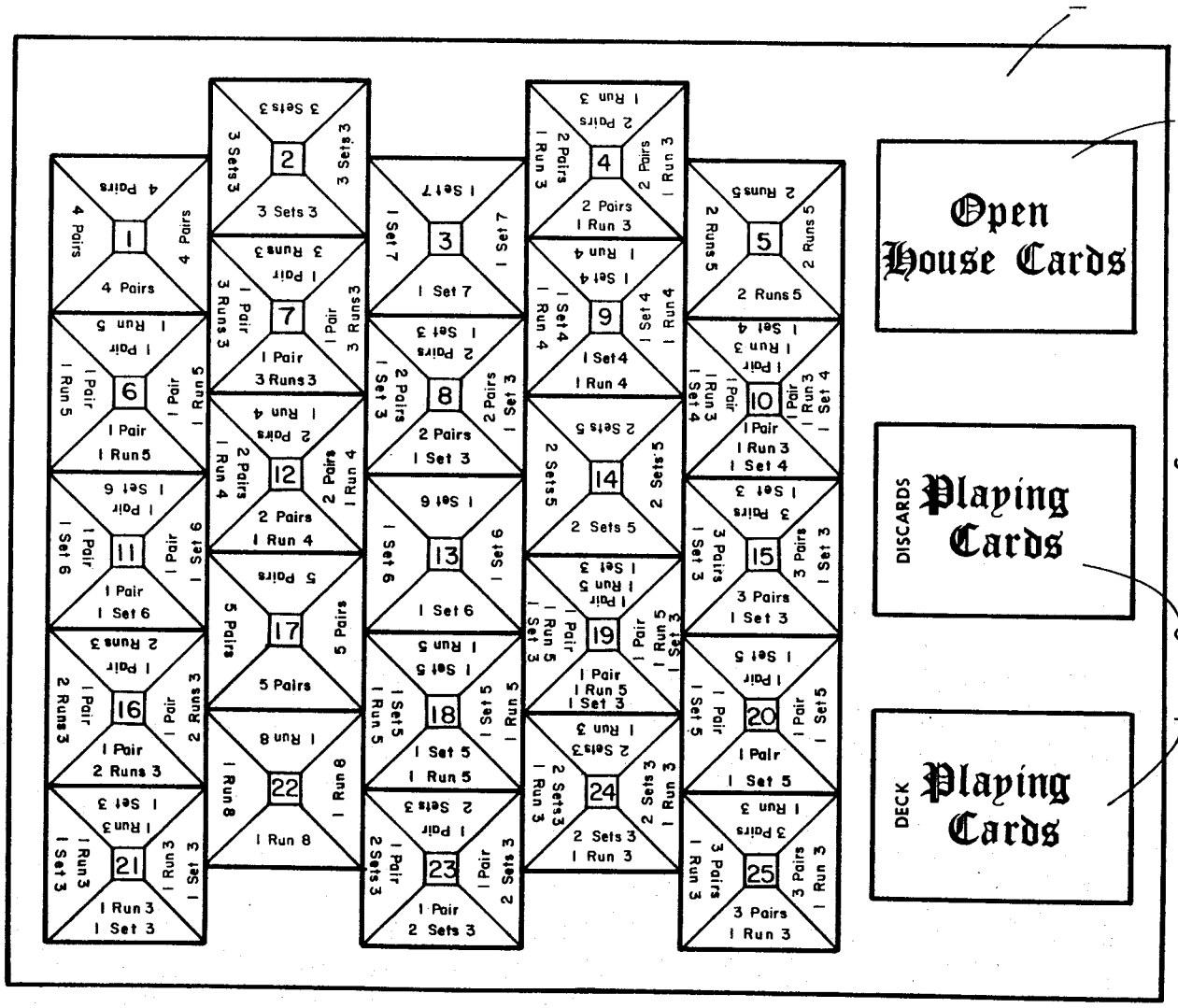

In the drawing, in FIG. 1, the number 1 illustrates the gameboard generally. The number 2 illustrates a space on the gameboard on which the Open House Cards are placed. The number 3 illustrates another space on the gameboard on which discarded conventional playing cards are placed during play. The number 4 illustrates a further space on the gameboard on which the conventional playing cards are placed during play.

Figure 2:
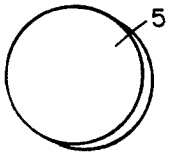
FIG. 2 illustrates the markers used in the game to denote the capture of squares on the gameboard by the players of the game. The markers are color-coded in three colors, differing from the color-codes of the squares.

In FIG. 2, the number 5 illustrates the 75 markers which are used to mark the squares captured by the individual players or teams during play.

Figure 3:
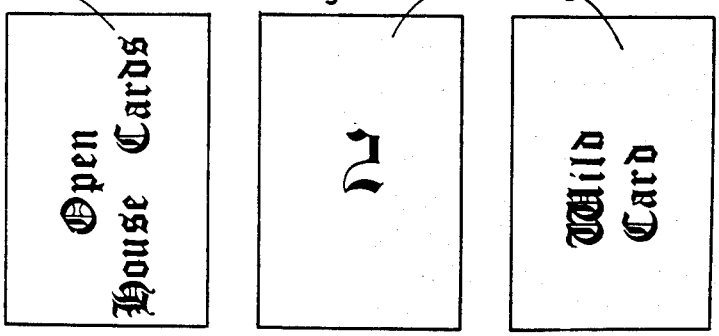
FIG. 3 illustrates the obverse of the 27 Open House Cards, numbered from 1 to 25 and the reverse of one of the numbered cards and the two Wild Open House Cards, used in the game.

In FIG. 3, the number 6 is a depiction of the obverse of the 27 Open House Cards used in the game. The number 7 is a depiction of the reverse of one of the 25 of the Open House Cards, numbered from 1 to 25, used in the game. The number 8 is a depiction of the reverse of the 2 Wild Open House Cards used in the game.

In FIG. 1, on the gameboard itself, eight squares numbered 1, 4, 8, 12, 15, 17, 21 and 25 are color-coded in pink. The eight squares numbered 2, 6, 9, 13, 16, 20, 23 and 24 are color-coded in green. The nine squares numbered 3, 5, 7, 10, 11, 14, 18, 19 and 22 are color-coded in yellow. The reasons for this are set forth in the description of the game equipment hereinafter set out.

The 75 markers, FIG. 2, used in the game are also color-coded in different colors from the color-codes of the squares, as hereinafter set out, so as to distinguish the squares captured by individual players, or teams of players, during the course of play.

The game equipment; the rules of play by from two to eight players or teams; and an illustration of the playing of the game by four people, as two-partner teams and of the criteria necessary for the winning of the game, are set out in detail in the following disclosure.

GAME EQUIPMENT

One distinctively stylized gameboard; 27 Open House cards, 25 numbered 1 to 25 and two marked "Wild Cards"; three decks of conventional playing cards(156 cards); 75 markers(25 colored red, 25 colored blue and 25 colored white).

Gameboard: The gameboard is made up of 25 squares, 8 colored pink, 8 colored green and 9 colored yellow. The colors of the squares on the gameboard represent the degree of difficulty of capturing those squares. The pink squares are the easiest to capture, the green squares are harder to capture, while the yellow squares are the most difficult to capture. The squares are disposed irregularly but contiguously on the board in such a manner that the board cannot be crossed from side to side or top to bottom without the player having to capture at least one yellow square.

Conventional Cards: The three decks of conventional playing cards are the standard commercial decks of playing cards.

Markers: The 75 markers which may be round, square or of any preferable shape, are used by the players who capture a square and may, of course, be of any conventional color, although the preferable colors are as stated above.

Wild Open House Cards: Two Open House cards are "Wild Cards" and may be used to capture any square on the board.

Wild Conventional Cards: All jokers and 2's in the conventional decks of cards are wild and may be used to fill in any pair, set or run. The 6 jokers and 12 twos in the three conventional decks of cards are used.

Note: At no time may a Wild Card be discarded. If a player does not wish to go out, to help his partner go down and has only Wild Cards left in his hand, he must play his cards out and end the hand.

Definition of Terms: A pair is 2 of a kind. A set is more of a kind. A run must be in the same suit.

Example: On laying down, if a player lays down 4 pairs to capture square 10, the player may then add to the pairs to get rid of more cards, but may not lay down a 5th pair, or a set, or a run. To illustrate, if the 4 pairs were 3's, 4's, 5's and 6's, he may then play any other 3's, 4's, 5's or 6's on the pair, or play on to any other players' hands already on the table, before he discards. He may increase runs, sets or pairs to sets, but not add new things to the board.

If at any time the draw deck of conventional cards has been gone through completely in one hand, the top card of the discarded deck is left on the rectangle on the board marked "Discard" and the deck is reshuffled.

RULES OF PLAY

When two people are playing, the first player down ends the hand. Three players same as two, use 3 different colored markers. Four players play as two partner teams. Five players play two teams of 2 and one individual. Both players on the team must be down to end the hand, or an individual down and out. Six players play two teams of three, played the same as four players. Seven players play two teams of two and one team of three. Eight players is best played as 2 teams of four with three players on a team going down to end the hand. In all games, any player going out, meaning he has no cards left after he discards, ends the hand.

ILLUSTRATION

With four people playing, as 2 partner teams.

Cut the deck. High card is the dealer. Aces are always high in cutting and playing; they are never low. The dealer then gives out three Open House cards to each player, beginning with the player to his immediate left. The cards are dealt face down one at a time. These cards, numbered 1 to 25 plus two Wild Cards, represent the numbers of the squares on the playing board. The dealer then deals out 12 conventional playing cards to each player, in the same manner. The remaining conventional cards are placed face down on the rectangle marked "Deck" on the board. The Open House cards are placed face down on the rectangle marked "Open House", on the board.

Play is ready to begin. The player to the left of the dealer picks the top playing card giving him 13 cards. If he down not wish to keep the first cards, he may place it face up on the rectangle on the board marked "Discard" and draw the next card from the top of the deck. Only the first player, after the deal, has this option to draw twice. Now the player must discard one or the 13 playing cards by placing it face up on the rectangle on the board marked "Discard". Play continues to the left. The next player may take the top discard which is face up for all to see or draw the top card from the deck. After a player discards, play moves on. Play continues in this manner until one player wishes to lay down.

Laying Down: After a player has drawn a card from the deck or discards a pile, he may lay down before he discards. The numbers of the three Open House cards the player is holding must correspond to the numbers of the squares that he may lay down on. Example: If a player is holding numbers 1, 5 and 12 and is able to lay down, (in front of himself and off the board), the requisite number of pairs, sets or runs written on any one of the squares numbered 1, 5 or 12, then he may do so. As soon as his cards are laid down, the player puts his marker on the corresponding numbered square and turns his Open House card around to show all players the number of the square that he has captured. The player then takes another Open House card and then discards a playing card. If the player discards and does not take another Open House card, he must play with only two Open House cards, making it much harder for him to "Open his House".

After a player has captured three squares and has completed his "Open House", he may then try to capture any other square on the board, which has not been taken by another player. In doing so, the player will try to complete the contiguously connecting line of squares from top to bottom or from side to side of the board, or attempt to block the opposition, making it harder for them to complete their cross of the connecting squares.

If a player who is open, captures a square that another player has taken, the player that plays must turn his Open House card up, to show all players and must now play with only two Open House cards. If a player has all three of his Open House card squares captured before he can open, he may draw another card immediately after the player preceding him has discarded.

The hand is over when two players on a team each capture a square by laying down their cards, or when any one player lays down all his cards with his last card being discarded. If one player lays down all 12 cards and discards his thirteenth, the hand is over and he, only, captures a square on that hand. This is usually done, only when that player's partner is having difficulty laying down.

WINNING

The player, or team, to get from side to side, or from top to bottom of the board on a contiguous line of squares, including at least one yellow square, wins. If both players, or all teams, are successful in blocking the others from achieving either of these goals, the team that captures 13 squares first, wins.

Object of Game: To be the first to form a connecting line of contiguous squares from top to bottom, or side to side, on the board, each line containing at least one yellow square.

Remember: The main strategy is to fill your Open House as quickly as possible, so you can block your opponent or start your bridge across, or up and down the line of contiguous squares on the board.

The above is my disclosure of my invention and discovery and as it is possible that my invention and discovery may be embodied in forms other than, or differing from, those set out in my present disclosure and specification, I claim as my invention and discovery all variations, modifications and other forms of this invention which may be justly deemed to fall within the scope of my appended claims.

The embodiments of my invention in which an exclusive property or privilege is claimed and on which I desire to obtain U.S. Letters Patent are defined as follows:

1. A game having a gameboard surface divided into 25 squares, color-coded in three colors and irregularly positioned thereon and contiguously connected, each square bearing a number and having playing indicia thereon, all the said squares being disposed and arranged on the board so as to form contiguous irregular lines across the board and from top to bottom and from said to side of the board, the squares being further arranged, in such a manner that it is requisite to capture at least one specifically colored square in each line, in order to form the said contiguous lines on the board and having a stylized Open House 27 card pack or deck, 25 of the said cards being consecutively numbered from 1 to 25 and identified thereon as Open House Cards and having two Wild Open House Cards identified thereon as Wild Cards and including the use of three decks of conventional cards, all said said cards being played according to the indicia on the squares and to the specific rules of the game and having a plurality of markers, color-coded in three colors, to mark the captures of squares by the players of the game, the playing of the game being governed by rules as to discards, draws and plays of the cards, with the object of the game being to be the first player or team of players, to capture a contiguous line of squares from top to bottom, or from side to side, or across, the board, the said line having to include at least one square colored in one requisite color of the three colors which distinguish the squares.

2. A game combination as described in claim 1, in which the 25 numbered squares on the board each bear playing indicia thereon indicating the card combination necessary to be held and played by each player, in order to capture each such square, which square, when captured, is marked by a color-coded marker indicating the player, or the team of players, which has captured that particular square.

3. A game as described in claim 1, in which if the objective of capturing a line of squares, including at least one square color-coded in the specific requisite color, is not achieved by any player or team of players, the game is won by the player or the team of players which first captures 13 of the squares on the gameboard.

* * * * *